US006439453B1

(12) United States Patent
Ramsay

(10) Patent No.: US 6,439,453 B1
(45) Date of Patent: Aug. 27, 2002

(54) CLOSURE CLIP FOR GABLE-TOP CARTON

(75) Inventor: George Ramsay, Grayslake, IL (US)

(73) Assignee: Tetra Laval Holdings & Finance, SA, Pully (CH)

( * ) Notice: Subject to any disclaimer, the term of this patent is extended or adjusted under 35 U.S.C. 154(b) by 0 days.

(21) Appl. No.: 09/698,602

(22) Filed: Oct. 27, 2000

(51) Int. Cl.[7] ..... B65D 45/04

(52) U.S. Cl. ..... 229/125.39; 229/125.12; 229/125.37

(58) Field of Search ..... 229/125.08, 125.12, 229/125.26, 125.37, 125.39, 125.42; 24/30.5 R; 383/69, 80

(56) References Cited

U.S. PATENT DOCUMENTS

| | | | | | |
|---|---|---|---|---|---|
| 2,172,930 | A | | 9/1939 | Bensel | |
| 2,533,539 | A | * | 12/1950 | Vivian | 24/30.5 R |
| 2,629,916 | A | * | 3/1953 | Footlick | 24/30.5 R |
| 3,217,967 | A | | 11/1965 | Jackson | |
| 3,381,883 | A | * | 5/1968 | Harris | 383/69 |
| 3,458,110 | A | * | 7/1969 | Goldman | 229/125.12 |
| 3,463,380 | A | | 8/1969 | Cooperstein | |
| 3,693,864 | A | | 9/1972 | Wilkins | |
| 4,109,351 | A | * | 8/1978 | Coffey | 229/125.37 |
| 4,619,398 | A | * | 10/1986 | Laramie | 229/125.12 |
| 4,979,668 | A | * | 12/1990 | Allen et al. | 229/125.39 |
| 5,024,375 | A | | 6/1991 | Wright | |
| 5,462,222 | A | * | 10/1995 | Boeck, II | 229/125.39 |

* cited by examiner

*Primary Examiner*—Gary E. Elkins
(74) *Attorney, Agent, or Firm*—Welsh & Katz, Ltd.

(57) ABSTRACT

A closure for use closing the fin panel of an associated gable top carton includes a pair of opposing side walls each defining a free end and being connected to one another at an opposing end by a bridge wall. The closure is pivotally mountable to the upstanding fin and extending along at least a portion of the fin panel. The closure is pivotal between a closed position wherein the side walls are urged over the fin panel to engage and compress separable portions of the fin panel together when the dispensing opening is closed, and an open position in which the side walls are pivoted away from the fin panel to disengage the separable portions of the fin panel to open the dispensing opening.

18 Claims, 2 Drawing Sheets

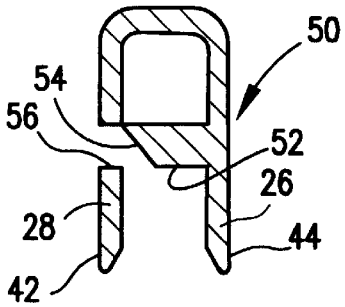
FIG. 5
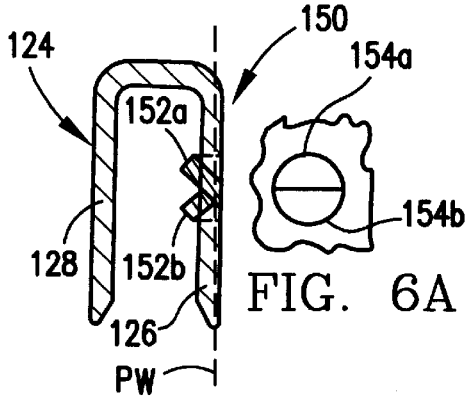
FIG. 6A
FIG. 6
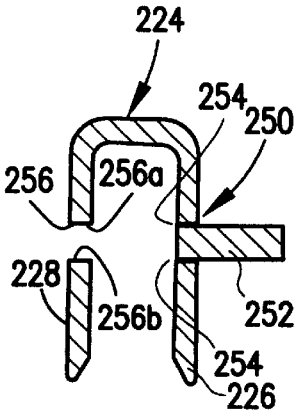
FIG. 7
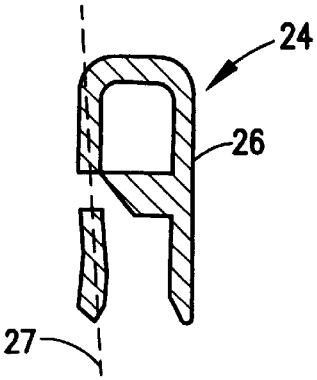
FIG. 8
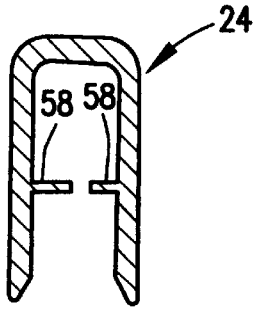
FIG. 9
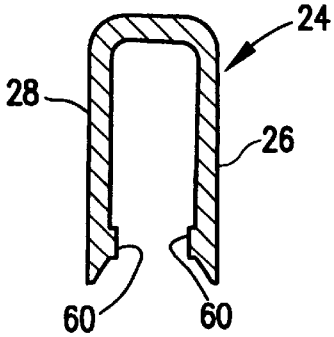
FIG. 10
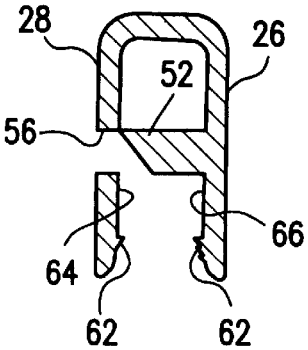
FIG. 11
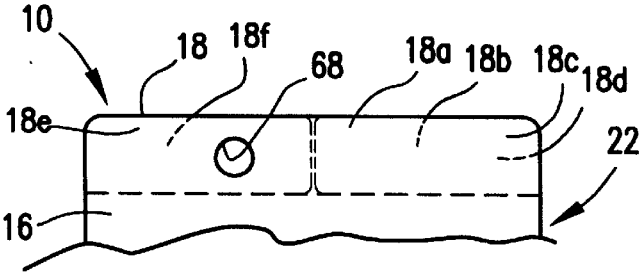
FIG. 12
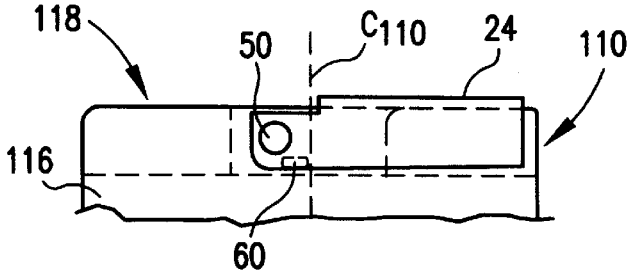
FIG. 13

CLOSURE CLIP FOR GABLE-TOP CARTON

FIELD OF THE INVENTION

This invention pertains to a closure for gable-top cartons. More particularly, the invention pertains to a hinged clip-type closure for resealing gable-top packages after initial opening.

BACKGROUND OF THE INVENTION

Gable-top and brick-type packages have become widely accepted by consumers, packagers and the like for packaging liquid foods, such as milk and juice. To a much lesser extent, these packages are in use for packaging particulate-containing liquid foods and solid foods. However, due to the nature of the arrangement of these packages, vis-a-vis the container opening or spout, their use has been limited with respect to solid foods.

The conventional gable-top package is the standard barer for packaging liquid foods. Closure technology associated with gable-top cartons has shifted toward the use of plastic or like spouts that are fixed to one of the gable panels of the carton. The spouts are typically resealable, such as by a threaded cap or a flip-type snap cap, to help prolong the life of the product after initial opening of the package. These closures impede oxidation of the packaged product in that they are liquid tight, and for the most part, gas impermeable. This has been seen as a quantum improvement over known gable-top package openings in which the sides of the gable are opened to form a spout from the underlying packaged material.

It has, however, been found that in many instances incorporating these spouts into packages is not a cost effective solution for packaging lesser expensive product. It has also been found that in some instances the spouts are not conducive for use with solid or particulate-containing product in that these spouts are not sufficiently large to allow dispensing the solid or particulate-containing product from the package. To this end, although gable-top packages are used for packaging these solid or particulate-containing products, resort is often made to the conventional panel opening gable carton,"Traditional" gable-top package drawbacks still exist, even when used with solid or particulate-containing product. For example, the product can be subject to oxidation (and in the case of packaged product that absorbs moisture, moisture ingress into the package and thus the product), and potentially spillage. While these drawbacks can discourage use of this type of package for these products, this package arrangement is nevertheless in use in that readily dispensing product from the package is of utmost importance.

Accordingly, there exists a need for a closure for a gable-top carton that provides a resealable, wide dispensing opening for the carton. Desirably, such a closure permits use of the dispensing opening that is formed by the gable panels of the package. Most desirably, such a closure provides spill proof, relatively liquid and gas impermeable resealing of the package after initial opening. Also most desirably, such a closure is a low cost component readily usable with standard gable-top cartons.

SUMMARY OF THE INVENTION

A closure for use with a gable top carton provides a resealable, wide dispensing opening for the carton by using the dispensing opening that is formed by the gable panels of the package. The closure provides spill proof, relatively liquid and gas impermeable resealing of the package after initial opening.

The closure is configured for use on a gable-top cartons having a plurality of side walls, a sealed bottom wall and a plurality of top walls including a pair of gable panels terminating at an upstanding fin panel. The fin panel has separable portions that are separable, in part, to form a dispensing opening. The separable portions are reopenable and resealable to open and close the dispensing opening.

The closure includes a pair of side walls each defining a free end and being connected to one another at an opposing end by a bridge wall. The closure is pivotally mountable to the upstanding fin and extends along at least a portion of the fin panel.

The closure is pivotal between a closed position wherein the side walls are urged over the fin panel to engage and compress the separable portions of the fin panel when the dispensing opening is closed, and an open position wherein the side walls are pivoted away from the fin panel to disengage the separable portions of the fin panel to open the dispensing opening.

In a current embodiment, the closure is permanently mounted to the carton fin panel. Alternately, the closure can be configured as an "after-market" item, in which it include a base portion and a pivotal portion pivotally mounted to the base portion. The base portion is configured for stationary receipt on the fin panel, spaced from the fin panel separable potions and the pivotal pivots from the base portion between the open and closed positions.

The closure defines a throat area for receiving the fin panel. A widened entry region can be formed adjacent the throat area. The side walls can be inwardly tapered from the bridge wall to the side wall free ends.

The closure defines a sealing region and a hinge region. A pivot is disposed at the hinge region for pivotally moving the closure between the open position and the closed position. The carton includes an opening formed in the fin panel, and the pivot is configured for receipt in the fin panel opening.

The pivot can be formed as a projection extending inwardly from an inner surface of one of the side walls. An opening can be formed in the other of the side walls in a projecting manner to the projection to facilitate forming (e.g., molding) a the projection integral with the side wall from which it extends. The projection can be formed having an angled end distal from the side wall from which the projection extends.

Alternately, the pivot can be formed as a portions of the side wall urged inwardly to define wing-like elements. Preferably, the wing-like elements have arcuate outermost portions to facilitate pivoting the closure between the open and closed positions.

Still alternately, the pivot can be formed as a stub extending outwardly from the side wall from which it is formed. In this configuration, the stub is connected to the side wall by at least one frangible portion. The frangible portions break wherein the stub is urged into the fin panel opening.

To assure that the stub remains in place in the closure, a receiving opening is formed in an opposing, projecting position on the opposite side wall. The receiving opening is configured for receiving the stub when the stub is urged from the side wall into the fin panel opening and the opposing side wall. Preferably, the receiving opening has angled walls for frictionally securing the stub therein.

In one configuration, the bridge wall extends along only the sealing region. This permits 180 degree rotation of the closure between the open and closed positions. The closure can be configured with one or more serrations formed in an inner surface of one or both side walls. The serrations extend inwardly of the side walls for frictionally engaging the fin panel when the closure is in the closed position.

Optionally, the closure includes one or more detents extending inwardly from an inner surface of the side walls near the pivot. The detents are engagable with the fin panel to maintain the closure in the open position.

Other features and advantages of the present invention will be apparent from the following detailed description, the accompanying drawings and the appended claims.

BRIEF DESCRIPTION OF THE FIGURES

FIG. 5 is an enlarged cross-sectional view taken along line 5—5 of FIG. 1, illustrated without the carton fin for clarity of illustration, showing one pivot arrangement for the closure;

FIG. 6 is a view similar to FIG. 5 illustrating an alternate pivot arrangement;

FIG. 7 is a view also similar to FIG. 5 illustrating yet another pivot arrangement;

FIG. 8 is another view similar to FIG. 5 illustrating an alternate cross-sectional arrangement of the closure having an angled side wall;

FIG. 9 is a cross-sectional view of the closure taken along line 9—9 of FIG. 4 illustrating optional audible closure indicators;

FIG. 10 is a cross-sectional view of the closure taken along line 10—10 of FIG. 4 illustrating optional projections for maintaining the closure in an open position;

FIG. 11 illustrates a cross-sectional view of the closure taken along line 11—11 of FIG. 4 illustrating optional serrations in the closure side walls (one serration in one wall and multiple serrations in the opposing wall) for maintaining the clip in the closed position;

FIG. 12 illustrates a standard, square cross-section carton having an opening or hole formed therein for receiving the pivot;

FIG. 13 illustrates a non-square cross-section carton having an opening or hole formed therein for receiving the pivot.

DETAILED DESCRIPTION OF THE REFERRED EMBODIMENTS

Figure 1:
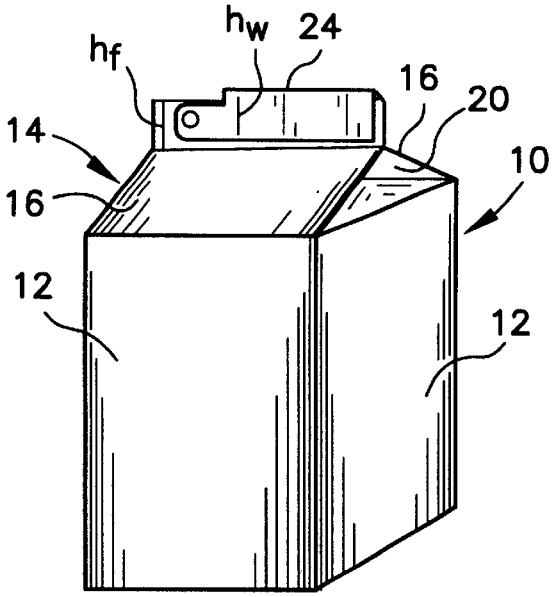
FIG. 1 is a perspective view of a conventional gable-top carton including one embodiment of a pivotal container closure embodying the principles of the present invention, the closure being illustrated in a closed or sealed position.

While the present invention is susceptible of embodiment in various forms, here is shown in the drawings and will hereinafter be described presently preferred embodiments with the understanding that the present disclosure is to be considered an exemplification of the invention and is not intended to limit the invention to the specific embodiments illustrated.

Referring to the figures and in particular to FIG. 1, there is shown a standard gable-top package or carton 10 that will be well recognized by those skilled in the art as well as most consumers. The gable-top package 10 includes upstanding side walls 12, a sealed bottom wall (not shown) and the familiar gable top 14. The gable top 14 is defined by exterior panels 16 that are sealed to one another at a fin 18. The gable portion 14 also includes interior gable panels 20 that fold inwardly, under the exterior gable panels 16.

Figure 2:
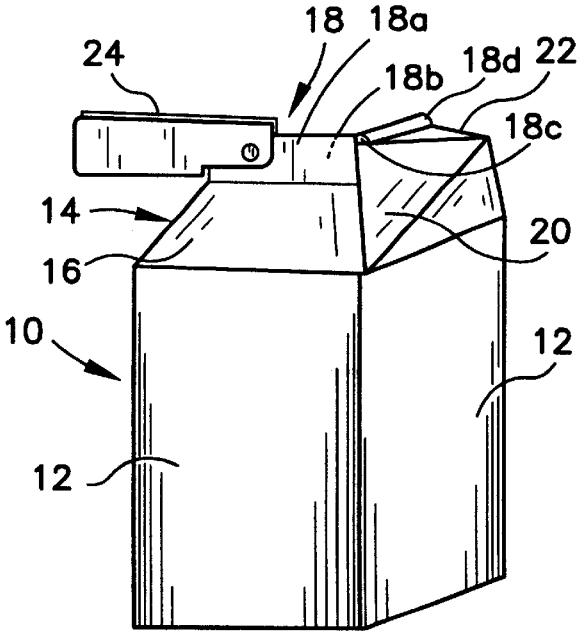
FIG. 2 is a perspective view of the carton and closure of FIG. 1 with the closure in the open position.

The fin is formed from panels 18*a–f*. The panels 18*a,b* (in part) and 18*c,d* can be separated from one another, as seen in FIG. 2, to form the familiar dispensing opening or pour spout 22. The spout 22 is merely urged open to dispense product from the carton 10, and folded inwardly to close the carton 10. As will be recognized by those skilled in the art as well as consumers, although this dispensing opening 22 provides a wide area for dispensing product from the carton 10, closing this traditional carton spout 22 does not effect a good seal for the stored product. To this end, moisture and/or oxygen can enter the carton 10 or the carton 10 can be turned onto an end, possibly resulting in spillage.

A closure 24 is fitted to the gable portion 14 at the fin 18. The closure 24 permits use of the wide opening 22 that is made by separating the gable panels (portions of 16, 20) and fin panels 18*a,b* and 18*c,d* at the top fin 18, and provides a positive reseal of the container 10 by exerting pressure on the fin panels 18 when it is in place.

Figure 3:
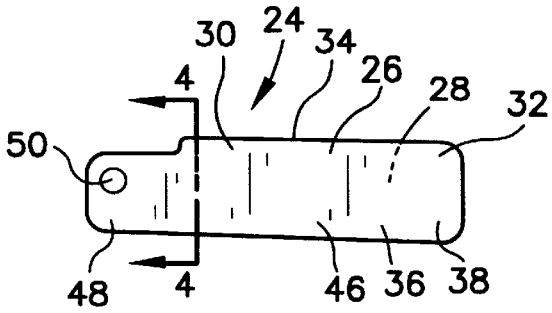
FIG. 3 is a front view of the closure of FIG. 1.
Figure 4:
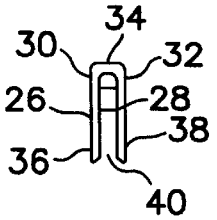
FIG. 4 is a side view of the closure.
Figure 14:
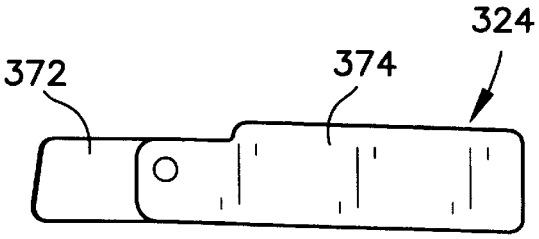
FIG. 14 illustrates front view of an alternate embodiment of an "after-market" closure.

Referring to FIGS. 1–3, the closure 24 is configured as a pivotable clip. It includes a pair of elongated side walls 26, 28 connected to one another at an upper end 30, 32 by a bridge wall 34. The clip 24 is configured so that free ends 36, 38 of the side walls 26, 28, opposite the bridge wall 34, define a throat area 40. The side walls 26, 28 can include outwardly turned portions 42, 44, at the free ends 36, 38 to provide an entrance into the constricted throat area 40. The walls 26, 28 can be tapered (as seen in FIG. 8, one wall tapered at 27) to provide for readily applying he clip 24 over the fin panels 18*a,b* and to further provide the restricted or reduced throat area 40.

The clip 24 is configured to fit over the fins panels 18*a,b* and squeeze or compress them together. This provides an excellent seal, and prevent the ingress of moisture and oxygen and the egress (i.e., leakage or spillage) of liquid, even if the carton 10 is inadvertently turned onto its side.

Referring to FIG. 3. the clip 24 includes a sealing region 46, a hinge region 48 and a hinge pin or pivot 50. The side walls 26, 28 extend along a length of the fin panels 18*a,b* and exert pressure on (i.e., compress) the panels 18*a,b* when in place. The walls 26, 28 have a height $h_w$ that is sufficient to permit positioning the clip 24 down over a sufficient height $h_f$ of the fin panels 18*a,b* to assure that it remains in place when positioned thereon.

The height $h_w$ of the walls 26, 28 can be shortened at about the hinge region 48. This can be formed by removing the bridge wall 34 at the hinge region 48. Referring to FIG. 2, this permits "flipping" the clip 24 rearward, out of the way of the fin panels 18*a,b* to open the carton 10. The height $h_w$ of the walls 26, 28 can be such that the clip 24 can be "flipped" about 180 degrees from the closed position (FIG. 1) to the open position (FIG. 2).

As will be described below, the pivot 50 can take many forms. In one embodiment, as seen in FIGS. 5, 8 and 11, the pivot 50 is formed as a projection 52 that extends as a simple, cylindrical element that is integral with and extends inwardly from one of the side walls, such as wall 26 of the closure 24. The projection 52 is formed having an angled end wall 54 to facilitate placement over the fin 18. An opening 56 is formed in the opposing side wall 28 in projecting fashion to the projection 52 . Such an arrangement permits readily manufacturing the closure 24. This is particularly so in that it is contemplated that the closure 24 will be formed in a molding process (such as an injection molding process) in which mold tools (not shown) will be required to form the pivot projection 52. The side wall opening 56 permits ready access for a mold tool into the interior portion of the closure 24 to form the projection 52.

FIGS. 6 and 6A illustrate an alternate pivot 150 that can be used with the present closure 124. In this alternate pivot 150 arrangement, a portion of the side wall 126 is partially punched or urged from the plane $P_w$ of the side wall 126, into the interior portion of the clip 124. The punched portions 152*a,b* (which as seen in FIG. 6 have a wing-like appearance) can be made having cured or arcuate upper and lower surfaces 154*a,b* to facilitate the pivoting function. In this manner, a relatively simple and straight forward pivot is formed from the side wall 126 material of the clip 124. Although now shown in FIGS. 6 and 6A, the wing-like, pivot elements 152*a,b* can be punched sufficiently deeply into the central portion of the clip 124 so as to extend essentially to the opposing side wall 128.

Referring to FIG. 7, still another alternate embodiment of the pivot 250 is formed as a projecting plug 252 in the side wall 226 of the clip 224. Again, an opening 256 is formed in the opposing side wall 228 in projection fashion to the plug 252. The plug 252 is formed integral with the side wall 226 and is connected thereto by relatively thin, frangible sections 254. In this manner, when the clip 224 is placed over the package 10 and appropriately positioned (as will be discussed in detail below) the plug 252 can be readily urged or pushed from the side wall 226 through the fin 18 and into the opposing side wall opening 256. In a contemplated embodiment, the opening 256 formed in the opposing side wall 228 has tapered surfaces 256*a,b* that taper inwardly toward the outer portion of that side wall 228. In this manner, when the plug 252 is urged through the fin 18 and into the opposing side wall 228, a friction fit is established at that side wall 228 to maintain the plug 252 properly positioned and secured on the fin 18.

Other pivot arrangements will be recognized by those skilled in the art, which other arrangements are within the scope and spirit of the present invention.

Optionally, as seen in FIG. 9, the clip 24 can include an arrangement by which an audible indication, such as a click, provides that the clip 24 has been fully urged on to the fin panels 18. In a contemplated embodiment, the clip 24 can include flexible, finger-like elements 58 extending inwardly from the side walls 26, 28 into the central portion of the clip 24. These flexible finger-like elements 58, when flexed as a result of passing over the fin panels 18*a,b* can be configured to provide this audible "click" to indicate that the clip 24 is properly secured on to the fin 18. Also optionally, as seen in FIG. 10, the clip 24 can be configured having one or more retaining members or detents 60 proximal to the pivot 50 location to maintain the clip 24 in an open position when the spout 22 is opened. To this end, the retaining detents 60 can be configured as projections that extend inwardly from about the free ends 36, 38 of the clip 24, near the pivot 50 location so that they interfere with the clip 24 if it inadvertently "falls" back on to the fin 18 when the carton 10 is open and in use.

In one embodiment, as discussed above, and as seen in FIG. 8, the throat area 40 is constricted relative to the space between the side walls 26, 28 near the bridge wall 34. This provides greater pressure or compression on the fin panels 8*a,b* at a location close to the gable panels 16. Optionally, as seen in FIG. 11, one or more serrations or gripping elements 62 can be formed on the inner surfaces 64, 66 of the side walls 26, 28. This too provides positive securing of the clip 24 to the fin 18 when in place.

As seen in FIGS. 12 and 13, the present clip 24 can be used on a variety of different sizes of gable-top packages 10. To this end, it is contemplated that a single size clip 24 can be used for most standard gable-top carton packages 10. For example, FIG. 12 illustrates the top and fin portion 18 of a standard gable-top package 10 (having a substantially square cross section) and in which the inner fin panels 18*c,d* and 18*e,f* essentially abut one another when the package 10 is sealed. The clip 24 is positioned on the package 10 such that the pivot 50 extends through the fin 18 at a portion that is spaced from those panels 18*c,d* that ultimately open to form the spout 22. This is necessary so that the pivot 50 does not interfere with opening the panels 18*c,d* that form the spout 22. To this end, a hole or opening 68 is formed in the fins 18 for receiving the pivot 50. As will be recognized by those skilled in the art, the opening 68 can be formed in the carton material during the converting process. Alternately, the opening 68 can be formed, such as by punching or cutting after the carton 10 has been filled and sealed.

FIG. 13 illustrates the top and fin 118 portion of a carton 110 in which the inner gable panels 118*c,d* and 118*e,f* do not extend all the way to a center line $C_{110}$ of the package 110. This would, perhaps, be the case in which a package 110 has a rectangular, rather than a square cross-sectional shape. In such a case, the pivot 50 can extend through only the exterior gable fin panels 118*a,b*. To this end, the clip 24 does not have to be as long as the entirety of the fin panels 118*a,b* and can, in fact, be considerably shorter in that back or rear end of the clip 24 does not have to extend all the way to or near an end of the fin 118. In such a configuration, the clip 24 will likely not pivot 180 degrees from the open position to the closed position, but will lie at an upward angle relative to the fin 118. As such, this embodiment 24 can include the retaining members 60 (best seen in FIG. 10) to maintain the clip 24 up and away from the dispensing opening 122 when in use.

Although it is contemplated that the present clip-type closure 24 is permanently affixed to the gable-top carton, it can also be configured as an after-market element 324 that is affixed to a carton 10 prior to use. Referring to FIG. 13, the clip 324 can include a first base portion 372 that is snuggly fitted on to the carton fin 18 and a pivotal portion 374 that is as described above. In this manner, the closure 324 can be used on a carton 10 until the carton is emptied and can subsequently be removed and replaced onto a subsequent or next carton package for use.

As described above, it is contemplated that the present closure 24–324 will be formed as a molded product, such as by injection molding. Material such as styrene or the like can be used for making the closure. Such materials are relatively light weight and sufficiently strong to provide the necessary gripping or compression force on the fin panels 18*a,b*, 118*a,b* when the closure or clip 24–324 is positioned thereon for resealing the carton 10, 110. Other materials will be recognized by those skilled in the art which the other materials are within the scope and spirit of the present invention.

In the present disclosure, the words "a" or "an" are to be taken to include both the singular and the plural. Conversely, any reference to plural items shall, where appropriate, include the singular.

From the foregoing it will be observed that numerous modifications and variations can be effectuated without departing from the true spirit and scope of the novel concepts of the present invention. It is to be understood that no limitation with respect to the specific embodiments illustrated is intended or should be inferred. The disclosure is intended to cover by the appended claims all such modifications as fall within the scope of the claims.

What is claimed is:

1. A resealable gable-top carton comprising:

a plurality of side walls and a sealed bottom wall, the carton including a plurality of top walls including a pair of gable panels terminating at an upstanding fin panel, the fin panel having separable portions that are separable, in part, to form a dispensing opening, the separable portions being reopenable and resealable to open and close the dispensing opening, the carton including an opening formed in the fin panel; and a closure defining a sealing region and a hinge region, the hinge region including a pivot for pivotally moving the closure between the open position and the closed position, the pivot being formed as a projection extending inwardly from an inner surface of one of the side walls, the closure being pivotally mounted to the upstanding fin, the closure having a pair of side walls each defining a free end and being connected to one another at an opposing end by a bridge wall, the side walls extending along at least a portion of the fin panel, the closure pivotal between a closed position wherein the side walls are urged over the fin panel to engage and compress the separable portions of the fin panel when the dispensing opening is closed to seal the dispensing opening and an open position wherein the side walls are pivoted away from the fin panel to disengage the separable portions of the fin panel to open the dispensing opening, wherein an opening is formed in the other of the side walls in a projecting manner to the projection.

2. A resealable gable-top carton comprising:

a plurality of side walls and a sealed bottom wall, the carton including a plurality of top walls including a pair of gable panels terminating at an upstanding fin panel, the fin panel having separable portions that are separable, in part, to form a dispensing opening, the separable portions being reopenable and resealable to open and close the dispensing opening, the carton including an opening formed in the fin panel; and a closure defining a sealing region and a hinge region, the hinge region including a pivot for pivotally moving the closure between the open position and the closed position, the pivot being formed as a projection extending inwardly from an inner surface of one of the side walls, the closure being pivotally mounted to the upstanding fin, the closure having a pair of side walls each defining a free end and being connected to one another at an opposing end by a bridge wall, the side walls extending along at least a portion of the fin panel, the closure pivotal between a closed position wherein the side walls are urged over the fin panel to engage and compress the separable portions of the fin panel when the dispensing opening is closed to seal the dispensing opening and an open position wherein the side walls are pivoted away from the fin panel to disengage the separable portions of the fin panel to open the dispensing opening, wherein the projection has an angled end distal from the side wall from which the projection extends.

3. A resealable gable-top carton comprising:

a plurality of side walls and a sealed bottom wall, the carton including a plurality of top walls including a pair of gable panels terminating at an upstanding fin panel, the fin panel having separable portions that are separable, in part, to form a dispensing opening, the separable portions being reopenable and resealable to open and close the dispensing opening, the carton including an opening formed in the fin panel; and a closure defining a sealing region and a hinge region, the hinge region including a pivot for pivotally moving the closure between the open position and the closed position, the closure being pivotally mounted to the upstanding fin, the closure having a pair of side walls each defining a free end and being connected to one another at an opposing end by a bridge wall, the side walls extending along at least a portion of the fin panel, the closure pivotal between a closed position wherein the side walls are urged over the fin panel to engage and compress the separable portions of the fin panel when the dispensing opening is closed to seal the dispensing opening and an open position wherein the side walls are pivoted away from the fin panel to disengage the separable portions of the fin panel to open the dispensing opening, wherein the pivot is formed as a portion of at least one of the side walls urged inwardly to define wing-like elements, the wing-like elements having arcuate outermost portions.

4. The resealable gable-top carton in accordance with claim 3 wherein two wing-like elements are formed divergingly from the side wall from which the wing-like elements are formed.

5. A resealable gable-top carton comprising:

a plurality of side walls and a sealed bottom wall, the carton including a plurality of top walls including a pair of gable panels terminating at an upstanding fin panel, the fin panel having separable portions that are separable, in part, to form a dispensing opening, the separable portions being reopenable and resealable to open and close the dispensing opening, the carton including an opening formed in the fin panel; and a closure defining a sealing region and a hinge region, the hinge region including a pivot for pivotally moving the closure between the open position and the closed position, the closure being pivotally mounted to the upstanding fin, the closure having a pair of side walls each defining a free end and being connected to one another at an opposing end by a bridge wall, the side walls extending along at least a portion of the fin panel, the closure pivotal between a closed position wherein the side walls are urged over the fin panel to engage and compress the separable portions of the fin panel when the dispensing opening is closed to seal the dispensing opening and an open position wherein the side walls are pivoted away from the fin panel to disengage the separable portions of the fin panel to open the dispensing opening, wherein the pivot is formed as a stub extending outwardly from the side wall from which it is formed, wherein the stub is connected to the side wall from which it is formed by at least one frangible portion, and wherein the frangible portions break wherein the stub is urged into the fin panel opening.

6. The resealable gable-top carton in accordance with claim 5 wherein the closure is formed having a receiving opening in an opposing, projecting position on the opposite side wall from which the stub is formed, and wherein the stub is configured for receipt in the side wall opening when the stub is urged from the side wall from which it is formed into the fin panel opening.

7. The resealable gable-top carton in accordance with claim 6 wherein the receiving opening has angled walls for frictionally securing the stub therein.

8. A resealable gable-top carton comprising:

a plurality of side walls and a sealed bottom wall, the carton including a plurality of top walls including a pair of gable panels terminating at an upstanding fin panel, the fin panel having separable portions that are separable, in part, to form a dispensing opening, the separable portions being reopenable and resealable to open and close the dispensing opening; and a closure pivotally mounted to the upstanding fin, the closure having a pair of side walls each defining a free end and being connected to one another at an opposing end by a bridge wall, the side walls extending along at least a portion of the fin panel, the closure pivotal between a closed position wherein the side walls are urged over the fin panel to engage and compress the separable portions of the fin panel when the dispensing opening is closed to seal the dispensing opening and an open position wherein the side walls are pivoted away from the fin panel to disengage the separable portions of the fin panel to open the dispensing opening, wherein the closure includes at least one serration formed in an inner surface of at least one of the side walls, extending inwardly thereof, the at least one serration configured for frictionally engaging the fin panel when the closure is in the closed position.

9. A rescalable gable-top carton comprising:

a plurality of side walls and a sealed bottom wall, the carton including a plurality of top walls including a pair of gable panels terminating at an upstanding fin panel, the fin panel having separable portions that are separable, in part, to form a dispensing opening, the separable portions being reopenable and resealable to open and close the dispensing opening; and a closure pivotally mounted to the upstanding fin, the closure defining a sealing region and a hinge region and wherein the closure includes a pivot for pivotally moving the closure between the open position and the closed position, the pivot being disposed within the hinge region, the closure having a pair of side walls each defining a free end and being connected to one another at an opposing end by a bridge wall, the side walls extending along at least a portion of the fin panel, the closure pivotal between the closed position wherein the side walls are urged over the fin panel to engage and compress the separable portions of the fin panel when the dispensing opening is closed to seal the dispensing opening and the open position wherein the side walls are pivoted away from the fin panel to disengage the separable portions of the fin panel to open the dispensing opening, wherein the closure includes a detent extending inwardly from an inner surface of one of the side walls, the detent being engagable with the fin panel to maintain the closure in the open position.

10. A closure for use with an associated gable top carton, the carton having a plurality of side walls and a sealed bottom wall, the carton including a plurality of top walls including a pair of gable panels terminating at an upstanding fin panel, the fin panel having separable portions that are separable, in part, to form a dispensing opening, the separable portions being reopenable and resealable to open and close the dispensing opening, the closure comprising:

a pair of side walls each defining a free end and being connected to one another at an opposing end by a bridge wall, the closure defining a sealing region and a hinge region, the closure including a pivot disposed within the hinge region for pivotally mounting to the upstanding fin and configured for receipt within a fin panel opening, the pivot being formed as a projection extending inwardly from an inner side surface of one of the side walls, the closure side walls extending along at least a portion of the fin panel, the closure being pivotal between a closed position wherein the side walls are urged over the fin panel to engage and compress the separable portions of the fin panel when the dispensing opening is closed to seal the dispensing opening and an open position wherein the side walls are pivoted away from the fin panel to disengage the separable portions of the fin panel to open the dispensing opening, the bridge wall extending along only the sealing region, wherein an opening is formed in the other of the side walls in a projecting manner to the projection.

11. A closure for use with an associated gable top carton, the carton having a plurality of side walls and a sealed bottom wall, the carton including a plurality of top walls including a pair of gable panels terminating at an upstanding fin panel, the fin panel having separable portions that are separable, in part, to form a dispensing opening, the separable portions being reopenable and resealable to open and close the dispensing opening, the closure comprising:

a pair of side walls each defining a free end and being connected to one another at an opposing end by a bridge wall, the closure defining a sealing region and a hinge region, the closure including a pivot disposed within the hinge region for pivotally mounting to the upstanding fin and configured for receipt within a fin panel opening, the pivot being formed as a projection extending inwardly from an inner side surface of one of the side walls, the closure side walls extending along at least a portion of the fin panel, the closure being pivotal between a closed position wherein the side walls are urged over the fin panel to engage and compress the separable portions of the fin panel when the dispensing opening is closed to seal the dispensing opening and an open position wherein the side walls are pivoted away from the fin panel to disengage the separable portions of the fin panel to open the dispensing opening, the bridge wall extending along only the sealing region, wherein the projection has an angled end distal from the side wall from which the projection extends.

12. A closure for use with an associated gable top carton, the carton having a plurality of side walls and a sealed bottom wall, the carton including a plurality of top walls including a pair of gable panels terminating at an upstanding fin panel, the fin panel having separable portions that are separable, in part, to form a dispensing opening, the separable portions being reopenable and resealable to open and close the dispensing opening, the closure comprising:

a pair of side walls each defining a free end and being connected to one another at an opposing end by a bridge wall, the closure defining a sealing region and a hinge region, the closure including a pivot disposed within the hinge region for pivotally mounting to the upstanding fin and configured for receipt within a fin panel opening, the closure side walls extending along at least a portion of the fin panel, the closure being pivotal between a closed position wherein the side walls are urged over the fin panel to engage and compress the separable portions of the fin panel when the dispensing opening is closed to seal the dispensing opening and an open position wherein the side walls are pivoted away from the fin panel to disengage the separable portions of the fin panel to open the dispensing opening, the bridge wall extending along only the sealing region, wherein the pivot is formed as a portion of at least one of the side walls urged inwardly to define wing-like elements, the wing-like elements having arcuate outermost portions.

13. The closure in accordance with claim 12 wherein two wing-like elements are formed divergingly from the side wall from which the wing-like elements are formed.

14. A closure for use with an associated gable top carton, the carton having a plurality of side walls and a sealed bottom wall, the carton including a plurality of top walls including a pair of gable panels terminating at an upstanding fin panel, the fin panel having separable portions that are separable, in part, to form a dispensing opening, the separable portions being reopenable and resealable to open and close the dispensing opening, the closure comprising:

a pair of side walls each defining a free end and being connected to one another at an opposing end by a bridge wall, the closure defining a sealing region and a hinge region, the closure including a pivot disposed within the hinge region for pivotally mounting to the upstanding fin and configured for receipt within a fin panel opening, the closure side walls extending along at least a portion of the fin panel, the closure being pivotal between a closed position wherein the side walls are urged over the fin panel to engage and compress the separable portions of the fin panel when the dispensing opening is closed to seal the dispensing opening and an open position wherein the side walls are pivoted away from the fin panel to disengage the separable portions of the fin panel to open the dispensing opening, the bridge wall extending along only the sealing region, wherein the pivot is formed as a stub extending outwardly from the side wall from which it is formed, wherein the stub is connected to the side wall from which it is formed by at least one frangible portion, and wherein the frangible portions break wherein the stub is urged into the fin panel opening.

15. The closure in accordance with claim 14 wherein the closure is formed having a receiving opening in an opposing, projecting position on the opposite side wall from which the stub is formed, and wherein the stub is configured for receipt in the side wall opening when the stub is urged from the side wall from which it is formed into the fin panel opening.

16. The closure in accordance with claim 15 wherein the receiving opening has angled walls for frictionally securing the stub therein.

17. A closure for use with an associated gable top carton, the carton having a plurality of side walls and a sealed bottom wall, the carton including a plurality of top walls including a pair of gable panels terminating at an upstanding fin panel, the fin panel having separable portions that are separable, in part, to form a dispensing opening, the separable portions being reopenable and resealable to open and close the dispensing opening, the closure comprising:

a pair of side walls each defining a free end and being connected to one another at an opposing end by a bridge wall, the closure being pivotally mountable to the upstanding fin, the closure side walls extending along at least a portion of the fin panel and being pivotal between a closed position wherein the side walls are urged over the fin panel to engage and compress the separable portions of the fin panel when the dispensing opening is closed to seal the dispensing opening and an open position wherein the side walls are pivoted away from the fin panel to disengage the separable portions of the fin panel to open the dispensing opening, the closure further including at least one serration formed in an inner surface of at least one of the side walls, extending inwardly thereof, the at least one serration configured for frictionally engaging the fin panel when the closure is in the closed position.

18. A closure for use with an associated gable top carton, the carton having a plurality of side walls and a sealed bottom wall, the carton including a plurality of top walls including a pair of gable panels terminating at an upstanding fin panel, the fin panel having separable portions that are separable, in part, to form a dispensing opening, the separable portions being reopenable and resealable to open and close the dispensing opening, the closure comprising:

a pair of side walls each defining a free end and being connected to one another at an opposing end by a bridge wall, the closure defining a sealing region and a hinge region and including a pivot within the hinge region for pivotally mounting to the upstanding fin, the closure side walls extending along at least a portion of the fin panel and being pivotal between a closed position wherein the side walls are urged over the fin panel to engage and compress the separable portions of the fin panel when the dispensing opening is closed to seal the dispensing opening and an open position wherein the side walls are pivoted away from the fin panel to disengage the separable portions of the fin panel to open the dispensing opening, wherein the closure includes a detent extending inwardly from an inner surface of one of the side walls, the detent being engagable with the fin panel to maintain the closure in the open position.

* * * * *